US006047407A

United States Patent [19]

Habel

[11] Patent Number: 6,047,407

[45] Date of Patent: Apr. 11, 2000

[54] HAT WITH CANDLES DEPICTED THEREON

[76] Inventor: Carolyn Louise Habel, 4191 Glenwood St., Little Neck, N.Y. 11363

[21] Appl. No.: 08/999,196

[22] Filed: Dec. 29, 1997

[51] Int. Cl.[7] ..... A41D 27/08

[52] U.S. Cl. ..... 2/244; 2/209.13; D2/869

[58] Field of Search ..... 2/209.13, 244, 2/905, 906; 362/103, 105, 106, 107, 108; 431/295; D2/869, 870, 871, 872, 873, 874, 897, 980, 981; D26/9, 10

[56] References Cited

U.S. PATENT DOCUMENTS 251,025 12/1881 Brittan ..... 362/105
4,321,708 3/1982 Troiano .
4,781,451 11/1988 McAllen .
4,991,235 2/1991 Warner .

*Primary Examiner*—Diana Oleksa
*Attorney, Agent, or Firm*—James Markey

[57] ABSTRACT

The present invention relates to novelty hats and items of clothing in general, and particularly to novelty hats having one or more candles, lamps or light holders depicted thereon. The hats may also be provided with flame tips or light bulbs which may be releasably attachable above the candles, lamps or light holders. Such hats may be worn by children during the joyous celebration of religious holidays, such as the Jewish holiday of Chanukah or the Christian holiday of Christmas.

12 Claims, 2 Drawing Sheets

HAT WITH CANDLES DEPICTED THEREON

FIELD OF THE INVENTION

The present invention relates to novelty hats and items of clothing in general, and particularly to novelty hats having one or more candles, lamps or light holders depicted thereon. The hats may also be provided with flame tips or light bulbs which may be releasably attachable above the candles, lamps or light holders. Such hats may be worn by children during the joyous celebration of religious holidays, such as the Jewish holiday of Chanukah or the Christian holiday of Christmas.

BACKGROUND OF THE INVENTION

While there are many novelty hats and items of clothing of different varieties known in the art, there are no novelty hats or items of clothing particularly designed and configured for depicting the lighting of candles or lamps thereon. Additionally, there are no such hats or items of clothing having a Menorah depicted thereon for use during the celebration of the eight-day holiday of Chanukah. Nor are there any such hats having a Christmas tree, an Easter candle or an Advent wreath depicted thereon for use during Christmas, Easter and Advent, respectively.

While it is also well known that certain hats, such as yarmulkes worn by Jewish males, are worn in the practice of certain religions, the novelty hats of the present invention are in no way meant to be a replacement for or a mockery of any such religious hats. Rather, the hats of the present invention are hats which children may wear during times of religious celebrations or rituals which involve the lighting of candles in order to allow children's participation without the danger of fire. For example, such hats may be worn by children during their play time during the Chanukah celebration, such as when spinning their dreidels.

Among the novelty hats known in the prior art is he hat disclosed in U.S. Pat. No. 4,991,235 wherein the at has the shape of an automobile, a motorcycle or a boat. he hat is provided with an adjustable interior headband having Velcro™ fasteners, i.e. detachably engaging plastic hook members and eye members, to allow the hat to fit on heads having various sizes and to permit the hat to be worn at various angles.

U.S. Pat. No. 4,321,708 discloses a golf cap with blinders pivoted to the sides of the visor. The blinder flaps are permanently attached to the cap along a portion of their length, and have one end releasably attached to the visor of the cap by Velcro™ pads, so as to permit the blinders to be inconspicuously secured when not in use.

U.S. Pat. No. 4,781,451 disclosed a pair of eye glasses or a visor having several patches of Velcro™ which are aligned to overlay several opposing patches of Velcro™ provided on the exterior of a headband or hat so as to allow the eye glasses or visor to be releasably attached to the headband or hat.

SUMMARY OF THE INVENTION

The present invention is directed to a hat or item of clothing which has the shape of one or more candles, lamps and/or light holders either depicted on its exterior or provided for permanent or releasable attachment to the hat or item of clothing. One or more flame tips or light bulbs, which are preferably releasably attachable to the hat adjacent to the top of the one or more candles, are provided for attachment to the hat to depict the lighting of the one or more candles, lamps and/or lights as a symbolic gesture during a time of celebration or other occasion. The hat may be of any shape, and may either fully or partially cover the wearer's head or may be a headband. The one or more candles and corresponding flame tips may be of any size or shape. While, for the sake of simplicity the embodiments of the invention will be referred to herein as hats, it is understood that the invention includes any item of clothing, such as a shirt or vest.

In one embodiment, the hat may have nine candles depicted on its front and the candles may be configured in the general shape of a Menorah wherein the center candle extends upwardly above the other eight candles. This embodiment may be worn by children during the Jewish religious celebration of Chanukah. The tallest candle and one other candle have flame tips or light bulbs attached to their top ends on the first day of Chanukah, and on each of the next seven days of Chanukah a flame tip or light bulb is attached adjacent the top of one of the remaining seven candles.

In another embodiment, the hat may have one large Easter candle depicted on its front. A flame tip or light bulb may be attached adjacent the top of the candle during the celebration of the Christian religious holiday of Easter and whenever appropriate.

In another embodiment, the hat may have four candles depicted on its front in the general configuration of an Advent wreath. During each of the four weeks of Advent, a candle may symbolically be lit by attaching a flame tip or light bulb to the top of the candle.

While it is preferable for the candles to be permanently attached to the hat and the flame tips to be releasably attachable, both the candles and the flame tips may be releasably attachable. Additionally, both the candles and the flame tips may be permanently attachable to the hat.

DESCRIPTION OF THE PREFERRED EMBODIMENTS

Figure 1:
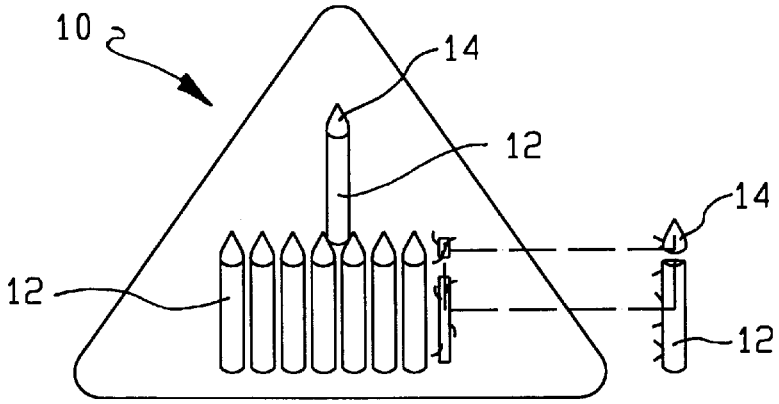
FIG. 1 is a planar view of a Chanukah hat embodiment of the invention wherein nine candles in the general configuration of a Menorah are depicted on the front of the hat.

In one preferred embodiment, the novelty hat of the present invention is formed in the generally pyramid shape of the hat 10 of FIG. 1. On the front fact thereof, hat 10 has depicted nine candles 12 which are in the general shape of a Menorah. Candles 12 may be releasably attachable to hat 10, however, they are preferably permanently attached thereto. If candles 12 are releasably attached, it is preferable to utilize interlocking plastic hooks and loops, such as Velcro™ fasteners.

Nine flames 14 are provided for attachment adjacent the tops of candles 12. Preferably, Velcro™ means for attachment are provided on the front face of hat 10 and on the rear face of flame tips 14 for releasable attachment thereto.

During the joyous celebration of the Jewish feast of Chanukah, on day one, the center flame 14 and one adjacent flame 14 may be releasably attached to hat 10 above respective candles 12. On each successive day during the celebration of Chanukah, a flame 14 may be releasably attached to the front face of hat 10 adjacent the top of a candle 12. As such, in using the hat made in accordance with the invention, young children may actively participate in the symbolic lighting of the Menorah during the eight days of Chanukah without the danger of exposing the children to the risk of open flames.

Figure 2:
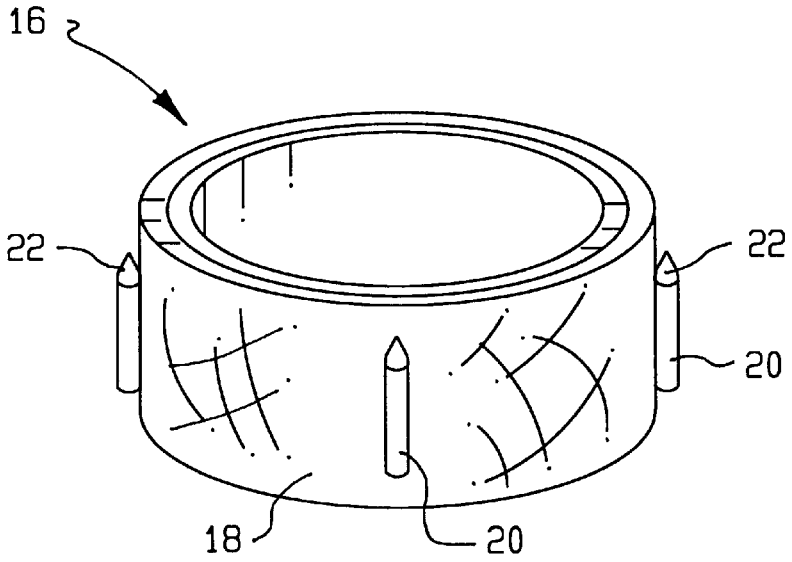
FIG. 2 is a planar view of an Advent hat embodiment of the present invention wherein the hat is in the form of a headband and is provided with four attachable candles and flame tips in the general shape of an Advent Wreath.

With reference to FIG. 2, another preferred embodiment of the invention is a generally cylindrical hat in the form of a headband 16 having depicted on the face thereof the general configuration of an evergreen Advent Wreath 18 having four candles 20. Preferably, and in the tradition of an Advent Wreath and the Christian religion, three of the candles are purple and one is pink. The candles 20 are prefrably situated around the wreath in an evenly spaced manner.

Flame tips 22 are provided for releasable attachment to the front face of hat 16. Preferably, Velcro™ attachment means are provided for releasably attaching flame tips 22 matching portions of Velcro™ attachment means may be provided on the front face of hat 16 adjacent the top of candles 20 and on the rear faces of flame tips 22. During the Christian religious practice of lighting an Advent Wreath candle for each of the four weeks of Advent, children may wear this embodiment of a novelty hat made in accordance with the invention, thereby taking part by symbolically lighting the candles on the hat without any danger associated with open flames.

While the foregoing embodiments illustrate the preferred attachment means of Velcro™ fasteners, any means of attachment for either permanent or releasable attachment may be used. For example, matching metallic pieces wherein one or both pieces is magnetized; matching male and female snap pieces wherein one piece has one or more protrusions and one piece has one or more matching cavities; adhesive of any type; and/or pins, such as safety pins or hat pins, may be utilized to affix the candles and/or flame tips to the hat.

Additionally, while the foregoing preferred embodiments illustrate a Chanukah hat having a Menorah depicted thereon and an Advent hat having an Advent Wreath depicted thereon, the present invention includes any hat having any number of candles in any configuration depicted thereon or permanently or releasably attachable thereto.

For example, one embodiment of a hat made according to the present invention may have a single large Easter candle depicted thereon. A flame tip is provided for releasably attaching to the hat adjacent the top of the Easter candle. Matching means for releasable attachment are provided on the front face of the hat adjacent the top of the candle and on the rear face of the flame tip.

Figure 3:
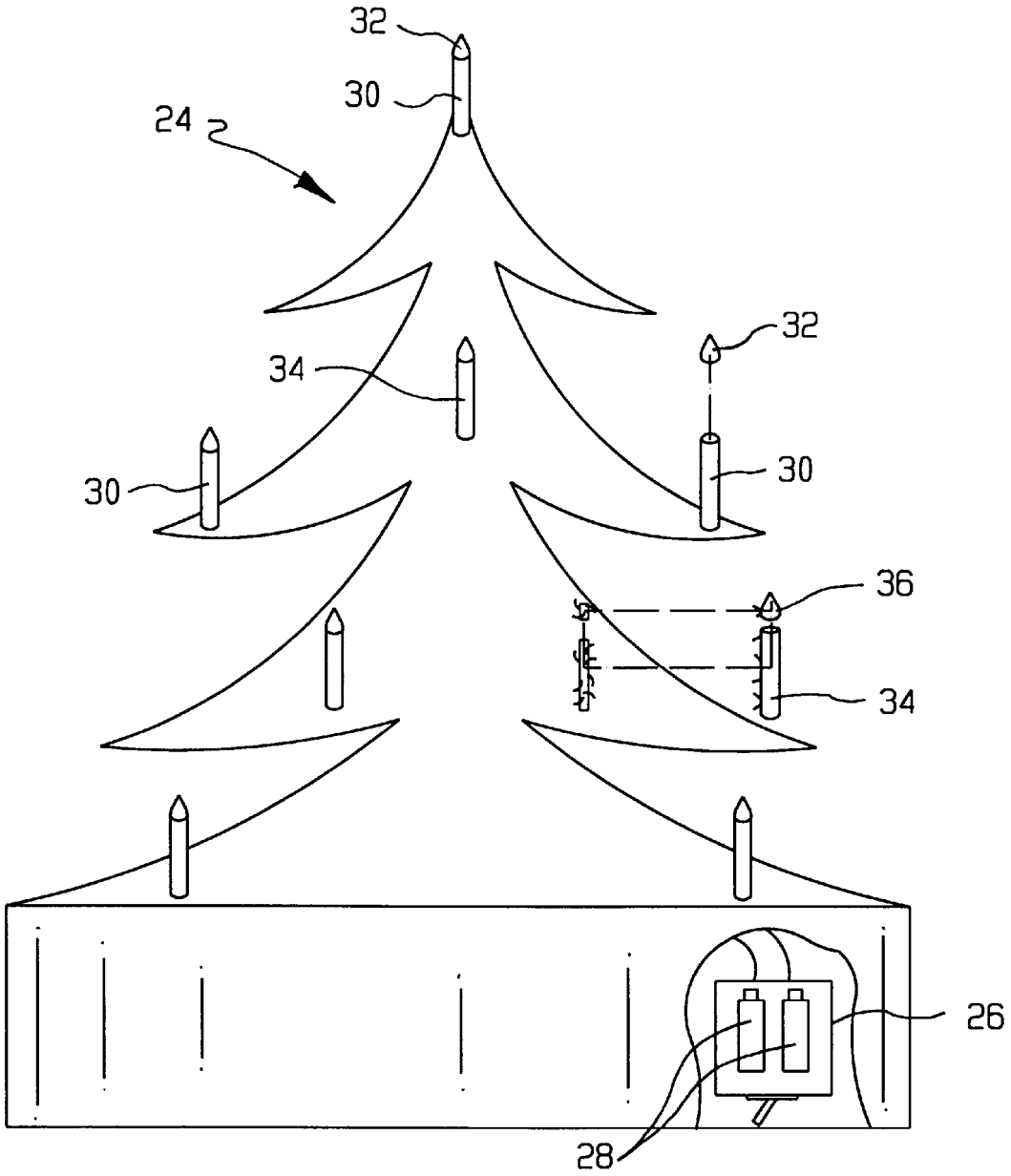
FIG. 3 is a planar view of a Christmas tree embodiment of the present invention wherein the hat is provided with one or more battery powered light sockets for insertion of a light bulb therein.

In another preferred embodiment of the invention as shown in FIG. 3, the hat 24 may be generally in the shape of an evergreen Christmas tree, such as a balsam fir tree. Hat 24 is provided with a battery housing 26 for holding a battery 28, and electrical wiring connecting said battery 28 to light socket 30 located adjacent the top of tree 24 and/or light sockets at other locations. Light bulb 32 is provided for removable insertion into light socket 30 by either a press-fit or by screwing an approximately shaped light bulb base into an appropriately groove-shaped light bulb socket, as is well known.

Christmas tree hat 24 may also be provided with candles 34 on one or more of the faces of the hat. Flame tips 36 and means for releasably attaching flame tips 36 adjacent the tops of candle 34. The hat 24 may have an interior layer of foam and an exterior layer of felt fabric. The candles and flame tips may be made of felt fabric, and the attachment means may be Velcro™ fasteners.

Numerous other embodiments of novelty hats made in accordance with the invention may also be constructed.

Essentially any material may be used for the hat, candles and flame tips. For example, and without limitation, any type of plastic, fabric, felt, foam, compressible foam, cardboard or paper, or any combination thereof, may be used to construct a hat in accordance wit the present invention. In a preferred embodiment, felt fabric is used for the hat, candles and flame tips, and an inner layer of compressible foam may be used in constructing the hat.

Additionally, any colors may be used for the hat, candles and flame tips. In a preferred embodiment of a hat made in accordance with the invention, having a Menorah depicted thereon, the hat is royal blue, the candles are white and the flame tips are yellow. For the embodiment of the invention having an Advent Wreath depicted thereon, the hat may be red or white, the evergreen wreath green three candles may be purple and one candle pink, and the flame tips may be yellow.

I claim:

1. An article of clothing having at least one depiction of a candle on an exterior face;

at least one flame-free depiction of a flame tip; and means for attaching each flame-free depiction of a flame tip adjacent the top of each depiction of a candle.

2. The item of claim 1 wherein the article of clothing is a hat.

3. The item of claim 2 wherein the front of said hat is generally triangular in shape.

4. The item of claim 1 wherein said at least one depiction of a candle are separate pieces of material which are attached to the item of clothing.

5. The item of claim 4 wherein said means for attaching each flame-free depiction of a flame tip adjacent the top of each candle comprises interlocking hook and loop type fasteners.

6. A novelty hat having at least one depiction of a candle on its exterior face;

at least one flame-free depiction of a flame tip; and means for releasably attaching said at least one flame-free depiction of a flame tip adjacent the tops of said at least one depiction of a candle.

7. The novelty hat of claim 6 having nine depictions of candles on the face;

nine flame-free depictions of flame tips; and said depictions of candles are generally configured in the shape of a Menorah.

8. The novelty hat of claim 7 wherein the means for attaching the flame-free depictions of flame tips comprises interlocking hook and loop type fasteners.

9. The novelty hat of claim 7 wherein said depictions of candles are separate pieces of material permanently attached to said hat.

10. The novelty hat of claim 6 having four depictions of candles on the exterior of the hat, with at least one of said depictions of candles on the front face;

four flame-free depictions of flame tips; and said depictions of candles are generally configured in the shape of an Advent Wreath.

11. The novelty hat of claim 10 wherein the depictions of candles are separate pieces of material permanently attached to the hat; and the means for attaching the flame-free depictions of flame tips comprises interlocking hook and loop type fasteners.

12. The novelty hat of claim 6 having the general configuration of an evergreen Christmas Tree;

the at least one depiction of a candle is a separate piece of material permanently attached to the hat; and the means for attaching the at least one flame-free depiction of a flame tip comprises hook and loop type fasteners.

* * * * *